US005333995A

United States Patent [19]

Jacobs et al.

[11] Patent Number: 5,333,995

[45] Date of Patent: Aug. 2, 1994

[54] WEAR SHIM FOR A TURBINE ENGINE

[75] Inventors: Keith G. Jacobs; Jeanne M. Rosario, both of Loveland; Michael H. Fisher, Cincinnati, all of Ohio

[73] Assignee: General Electric Company, Cincinnati, Ohio

[21] Appl. No.: 103,370

[22] Filed: Aug. 9, 1993

[51] Int. Cl.[5] ..... F01D 9/04; F01D 11/08

[52] U.S. Cl. ..... 415/209.2; 415/209.3; 415/173.1; 415/173.3

[58] Field of Search ..... 415/135, 136, 138, 191, 415/209.2, 209.3, 170.1, 173.1, 173.3, 173.4, 173.5, 173.6, 174.2

[56] References Cited

U.S. PATENT DOCUMENTS 2,885,768 5/1959 Shinn .
3,730,640 5/1973 Rice et al. ..... 415/173.6
3,790,299 2/1974 Sidler .
3,842,595 10/1974 Smith et al. .
4,177,004 12/1979 Riedmiller et al. ..... 415/136
4,314,792 2/1982 Chaplin .
4,573,867 3/1986 Hand ..... 415/136
4,868,963 9/1989 Corsmeier et al. .
5,188,507 2/1993 Sweeney ..... 415/173.1
5,192,185 3/1993 Leonard ..... 415/173.3
5,201,846 4/1993 Sweeney ..... 415/170.1
5,232,340 8/1993 Morgan ..... 415/209.2

*Primary Examiner*—Edward K. Look
*Assistant Examiner*—Christopher Verdier
*Attorney, Agent, or Firm*—Jerome C. Squillaro; John R. Rafter

[57] ABSTRACT

A wear shim assembly is provided which includes a substantially U-shaped wear shim for protecting selected wear surfaces on the engine casing of a gas turbine engine. The wear shim advantageously simultaneously protects multiple surfaces of the engine casing, namely, a radial seating surface and an axial seating surface of the engine casing, from undesired differential thermal expansion wear and vibrational wear.

8 Claims, 6 Drawing Sheets

WEAR SHIM FOR A TURBINE ENGINE

BACKGROUND OF THE INVENTION

This invention relates in general to gas turbine engines and, more particularly, to shims for use on gas turbine engines to prevent wear of selected engine surfaces.

As seen in FIG. 1, gas turbine engines typically include a compressor 10, a combustor 15 and a turbine 20 all contained within an engine case 25. Turbine 20 includes a plurality of stator vanes or nozzles 30, which are fixed with respect to engine casing 25, and a plurality of rotor blades 35 which are mounted on a rotary shaft 40. Conventional engines include an internal shroud within the interior of the engine to minimize the amount of air which bypasses the rotor blades. In this manner, as tight a fit as possible is provided between the top of the rotor blades and the engine case such that air does not undesirably go over the tip of the rotor blades and bypass the rotor blades.

Unfortunately, in conventional gas turbine engines, a large amount of engine case wear is observed at locations in the case where the shroud contacts the case. This occurs due to the high temperatures which are present in the engine. More particularly, when the engine is subjected to typical high temperature operating conditions of 1000–2500 degrees Fahrenheit, differential thermal expansion and corresponding relative movement is observed between the case and the shroud. In other words, the engine casing expands at a different rate than the shroud and those engine case locations where the shroud contacts the case are exposed to relative motion between these two parts. Undesired engine case wear thus occurs.

Another source of engine case wear is the differential thermal expansion of stator vanes or nozzles with respect to the case at case locations where such vanes are attached to the engine case.

Yet another source of engine casing wear is the relative motion between the case and shroud, and the case and stator vanes, which occurs due to high velocity air passing over the shroud and vanes.

Since the engine case is a very expensive component to replace, undesired engine case wear at case locations where the shrouds and vanes contact the engine case can cause significant maintenance expense.

It is known to dispose wear shims between 2 surfaces which are wearing with respect to each other, However, in gas turbine engines wear shims have thus far been attached to the engine case by an active retention members such as weldments and retaining pins. Such attachment techniques can make shim removal difficult and/or expensive.

SUMMARY OF THE INVENTION

Accordingly, one object of the present invention is to minimize undesired engine case wear caused by differential thermal expansion which occurs between the engine case and the engine shroud.

Another object of the present invention is to minimize undesired engine case wear caused by differential thermal expansion which occurs between the engine case and stator vanes.

Yet another object of the present invention is to minimize undesired engine case wear which occurs due to relative motion between the case and shroud and stator vanes which results from high velocity air passing over or through these parts.

Still another object of the present invention is to prevent undesired wear of the engine case without welding ancillary structures to the engine case and without using retaining pins to attach ancillary structures to the engine case.

Yet another object of the present invention is to protect multiple wear surfaces of the engine case simultaneously.

In accordance with one embodiment of the present invention, a wear shim assembly is provided. The wear shim assembly is situated in the interior of a gas turbine engine having a longitudinal axis. The engine includes an engine case and an array of stator vanes having mounting hooks attached to the interior of the engine case. The interior of the case includes a circumferential rail chamber for receiving the hooks of the nozzle vanes. The engine further includes a shroud or an array of shrouds in the interior of the engine case. The wear shim assembly of the invention includes a shim extending circumferentially about the interior of the engine case adjacent to the rail chamber, the case including a radial seating surface and an axial seating surface as part of the rail chamber. The shim further includes a first wear surface for protecting the radial seating surface of the engine case, the first wear surface being situated between the shroud and the radial seating surface. The shim still further includes a second wear surface for protecting the axial seating surface of the engine case, the second wear surface being situated between the shroud and the axial seating surface. This radial and axial surface protection technique applies as well to stator vane rail surfaces as will be discussed in more detail later.

Multiple wear surfaces of the engine casing are thus advantageously simultaneously protected by the shim assembly without the use of retention pins and weldments or other ancillary retention features.

BRIEF DESCRIPTION OF THE DRAWINGS

The features of the invention believed to be novel are specifically set forth in the appended claims. However, the invention itself, both as to its structure and method of operation, may best be understood by referring to the following description and accompanying drawings.

DETAILED DESCRIPTION OF THE INVENTION

Figure 1:
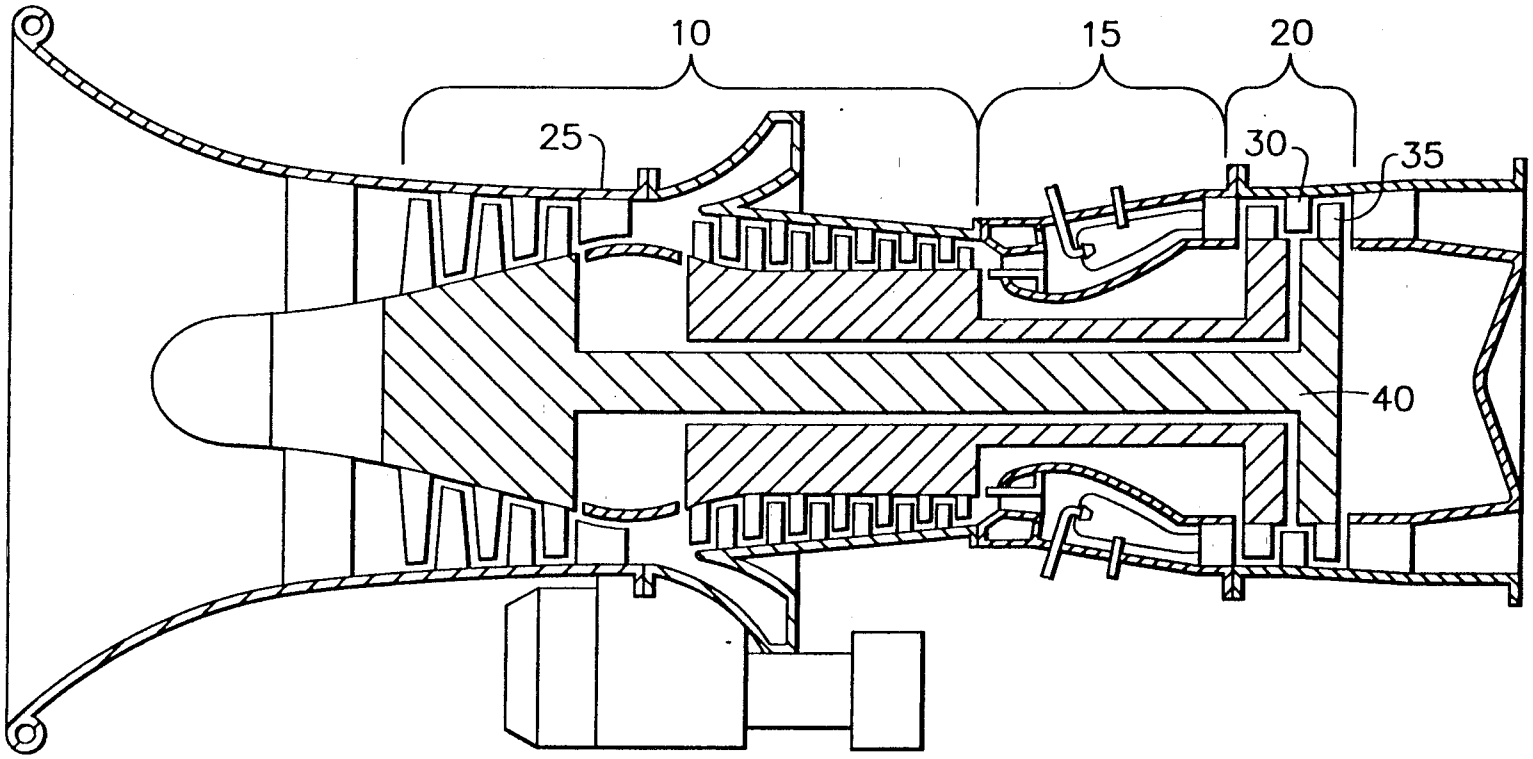
FIG. 1 is a cross sectional view of a conventional gas turbine engine.
Figure 2:
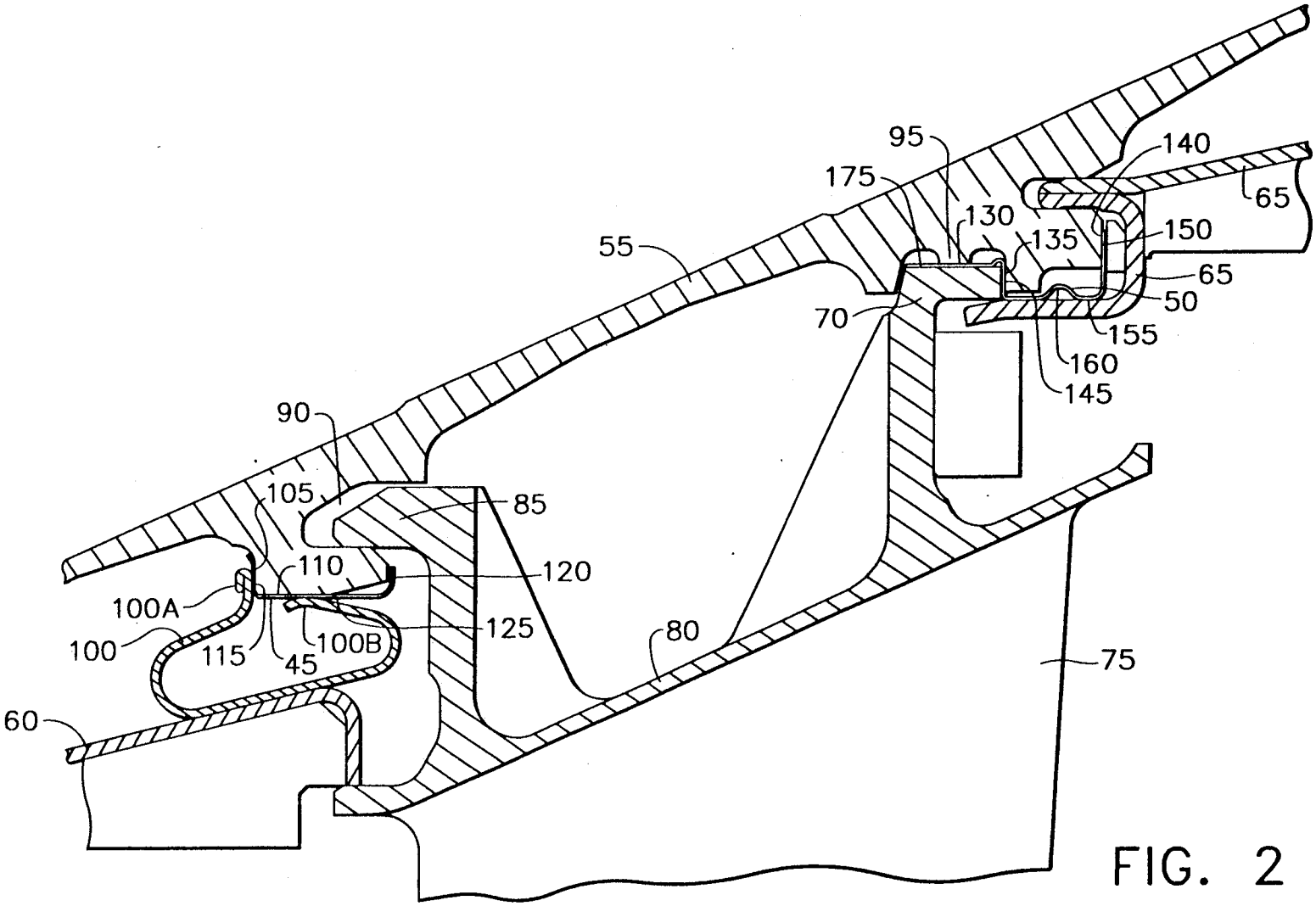
FIG. 2 is a cross sectional view of a portion of a gas turbine engine employing the wear shim of the present invention.

FIG. 2 depicts a representative portion of a gas turbine engine equipped with specially shaped wear shims 45 and 50 which prevent undesired wear of selected portions of gas turbine engine case or casing 55. It is noted that FIG. 2 is a portion of a cross section of a turbine engine and that in actual practice, the elements shown in FIG. 2 extend circumferentially around the engine.

Without shims 45 and 50, selected portions of engine casing 55 would be exposed to wear from the aft end of shroud 60 and the forward end of shroud 65 which are situated in the interior of the engine and within engine casing 55. Moreover, shim 50 also prevents a portion of engine casing 55 from being exposed to wear from hook 70 of stator vane or nozzle 75 which is mounted on engine casing 55 as shown. Those skilled in the art will appreciate that in actual practice, many turbine engines will include an array of shrouds and that the invention may be applied to such an array of shrouds to solve the wear problems thereof.

The outer platform 80 of stator vane 75 includes both hook 70 and hook 85 which facilitate the mounting of vane 75 to engine casing 55. More particularly, to mount vane 75 to engine casing 55, hook 85 is first situated in a cavity or forward rail 90 which substantially mates therewith. Vane 75 with hook 70 thereon is then rotated until hook 70 is situated within a mating cavity or aft rail 95.

A spring 100, which is considered to be a part of fore shroud 60, is situated between shroud 60 and casing 55 as shown. Spring 100 provides support and positioning to shroud 60 with respect to engine casing 55. In cross section, spring 100 exhibits a substantially elliptical shape which is split along the longer axis of the ellipse at springs ends 100A and 100B as shown.

It is seen in FIG. 2 that engine case 55 includes an axial seating surface 105 and a radial seating surface 110 which in this embodiment are substantially perpendicular. It is noted that perpendicularity of these two surfaces is not critical to the functioning of the disclosed shim structure. Rather than permitting spring end 100A to directly contact axial seating surface 105 and spring end 100B to directly contact radial seating surface 110, shim 45 is instead interposed therebetween to prevent undesired wear of casing 55 as shroud 60 and spring 100 move with respect to casing 55 during engine operation.

Figure 3:
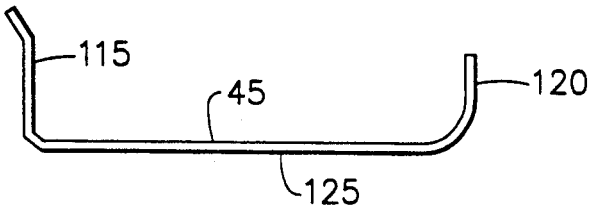
FIG. 3 is a cross sectional view of one embodiment of the wear shim of FIG. 2

More particularly, as seen in detail in FIG. 3, wear shim 45 exhibits a substantially U-like shape. Shim 45 includes side surfaces 115 and 120 which are substantially parallel and joined together by a connective member 125. Returning to FIG. 2, shim side surface 115 is disposed between axial seating surface 105 and spring end 100A of fore shroud 60 to prevent wear therebetween. In a similar manner, shim connective member 125 is disposed between radial seating surface 110 and spring end 100B of shroud 60 to prevent wear therebetween.

When wear shim 45 wears out due to differential thermal expansion and vibration between the engine elements which contact shim 45, it is replaced during routine maintenance of the engine. The undesired and expensive wear of axial seating surface 105 and radial seating surface 110 is thus avoided.

As seen in FIG. 2, engine casing 55 further includes a radial seating surface 130 at rail 95. Engine casing 55 also includes an axial seating surface 135 and an axial seating surface 140 which are substantially parallel in this particular embodiment of the invention. Rather than permitting hook 70 of vane 75 to directly contact radial seating surface 130, a portion of shim 50 is instead interposed therebetween. Similarly, instead of permitting axial seating surface 135 and axial seating surface 140 to directly contact hook 70 and shroud 65, respectively, portions of shim 50 are interposed therebetween.

Figure 4:
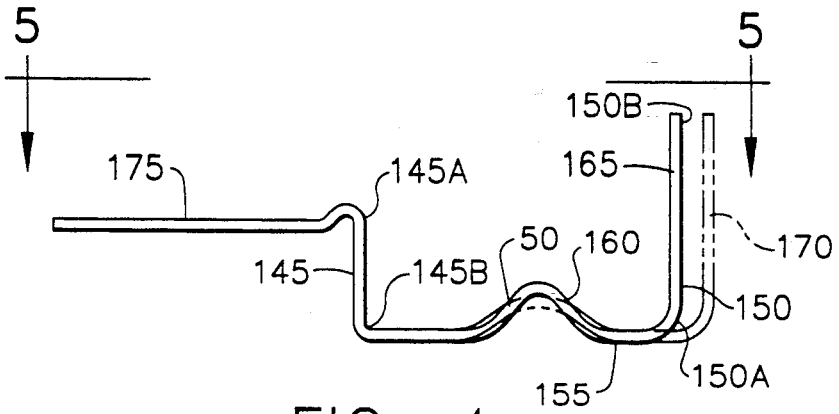
FIG. 4 is a cross sectional view of another embodiment of the wear shim of FIG. 2

More particularly, as seen in detail in FIG. 4, wear shim 50 exhibits a modified, substantially U-like shape. Shim 50 includes side surfaces 145 and 150 which are substantially parallel and joined together by a connective member 155. Side surface 145 includes opposed ends 145A and 145B, and side surface 150 includes opposed ends 150A and 150B. Connective member 155 includes a bend or dimple 160 which allows side surface 150 to move axially with respect to side surface 145 from position 165 to position 170 during installation of shim 50 onto casing 55. Connective member 155 thus exhibits a spring-like action during installation of shim 50.

Wear shim 50 further includes a circumferential radial surface member 175 which is attached to-side surface end 145A. Circumferential radial surface member 175 is oriented substantially perpendicular to side surface 145 and substantially parallel to connective member 155.

Returning to FIG. 2, circumferential radial surface member 175 is disposed between radial seating surface 130 and hook 70 to prevent wear therebetween. In a similar manner, shim side surface 145 is disposed between axial seating surface 135 and hook 70 to prevent wear between these components. Also, shim side surface 150 is disposed between axial seating surface 140 and shroud 65.

When wear shim 50 becomes worn out due to differential thermal expansion and vibration between the engine elements which contact shim 50, it is replaced during routine maintenance of the engine. The undesired and expensive wear of radial seating surface 130, axial seating surface 135 and axial seating surface 140 is thus avoided.

Figure 5:
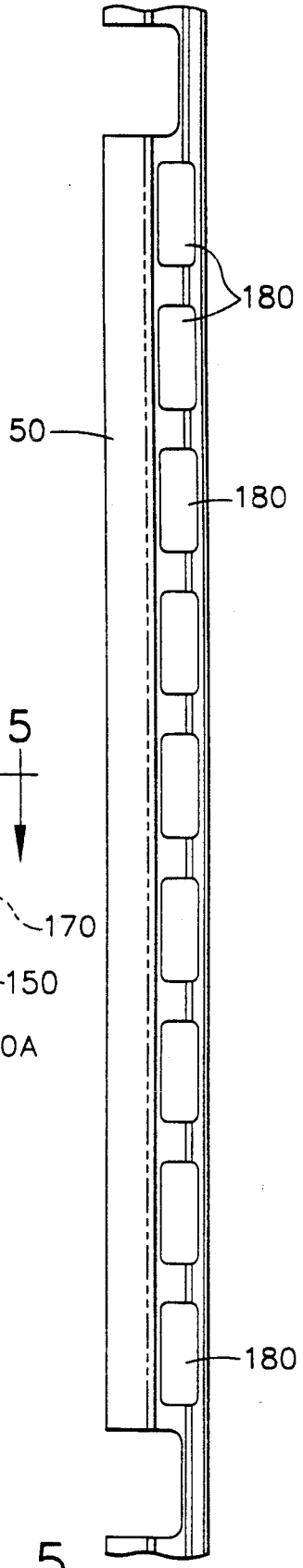
FIG. 5 is a top view of the wear shim of FIG. 4

In one-embodiment of wear shim 50 which is depicted in FIG. 5, shim 50 includes a plurality of cutouts 180. Cutouts 180 are spaced apart around the circumference of shim 50 to decrease the meridional Stiffness of shim 50. In this manner, the compliance of shim 50 is increased to permit easier installation of shim 50 on engine casing 55. Dimple 160 and cutouts 180 together cooperate to provide an "accordion" feature to allow shim 50 to "snap" onto casing 55 and thus permit shim 50 to be self-retaining.

Figure 6:
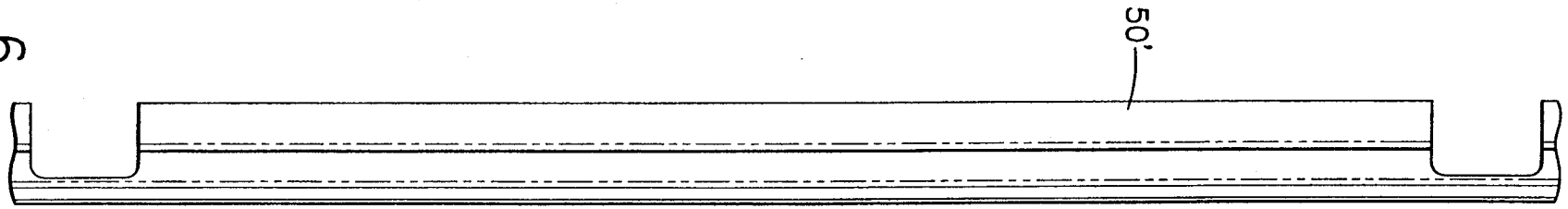
FIG. 6 is a top view of another embodiment of the wear shim of FIG. 4.

FIG. 6 shows another embodiment of shim 50 as shim 50' wherein cutouts 180 are eliminated as a cost savings.

Figure 7:
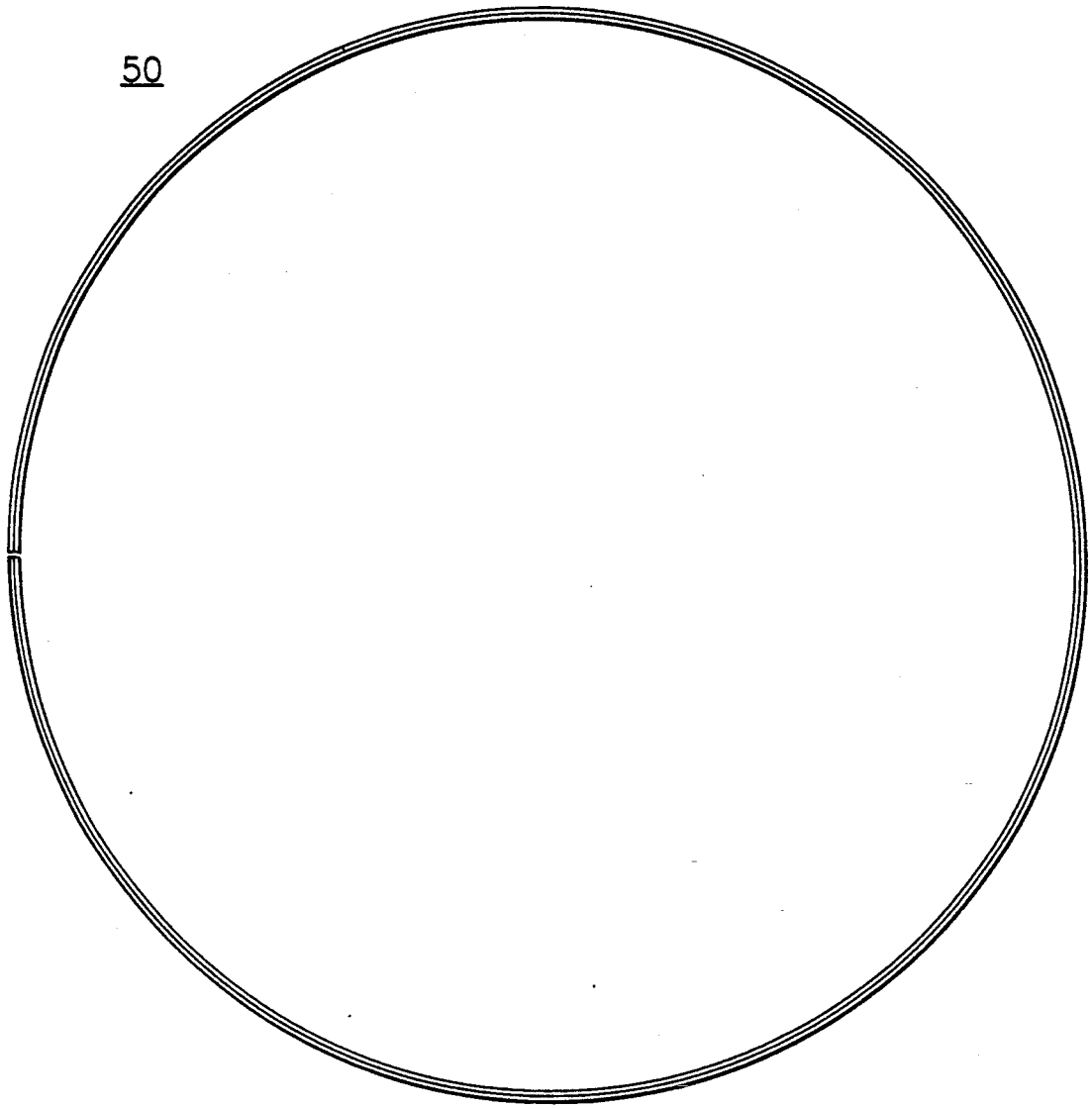
FIG. 7 is an end view of the wear shim of FIG. 4
Figure 8:
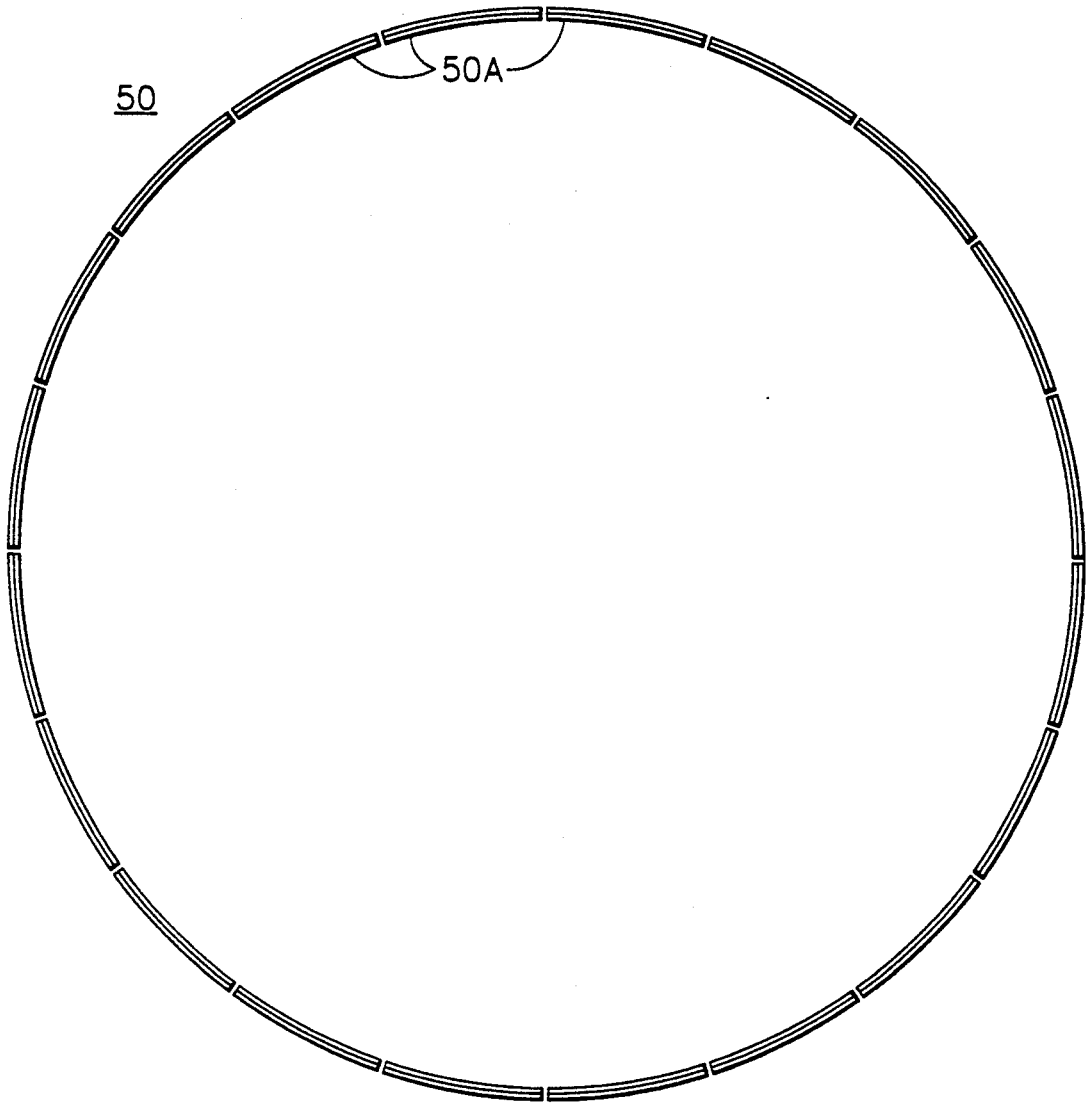
FIG. 8 is an end view of another embodiment of the wear shim of the invention.

FIG. 7 shows an end view of an embodiment of wear shim 50 wherein shim 50 exhibits a split-ring geometry. FIG. 8 shows an end view of another embodiment of wear shim 50 wherein shim 50 is divided into a plurality of smaller shim subsections or arcs 50A for ease of installation on engine casing 55.

It will be appreciated that shims 45 and 50 are not limited to being installed in any particular module or stage of a gas turbine engine such as a given turbine stage, but rather, these shims can be installed in other engine stages, such as a given compressor stage, for example, which exhibit similar problems of wear between the engine shroud and the engine casing, and wear between vane hooks and the engine casing.

The foregoing has described a wear shim for a gas turbine engine which minimizes undesired engine casing wear caused by differential thermal expansion which occurs between the engine casing and the engine shroud and between the engine casing and nozzle or stator vanes. The disclosed wear shim also minimizes undesired engine wear which results from vibration between the casing and shroud or vanes caused by high velocity air passing over the shrouds or vanes. The wear shim is advantageously employed without welding the shim or ancillary structures to the engine casing and without using retaining pins to attach the shim or ancillary structures to the engine casing. The disclosed shim advantageously protects multiple engine casing surfaces simultaneously. For example, radial seating surfaces and axial seating surfaces are simultaneously protected from wear.

While only certain preferred features of the invention have been shown by way of illustration, many modifications and changes will occur to those skilled in the art. It is, therefore, to be understood that the present claims are intended to cover all such modifications and changes which fall within the true spirit of the invention.

What is claimed is:

1. A wear shim assembly situated in the interior of a gas turbine engine having a longitudinal axis, said engine including an engine case and an array of stator vanes having mounting hooks attached to the interior of said engine case, the interior of said case including a circumferential rail chamber for receiving the hooks of said stator vanes, said engine including a shroud in the interior of said engine case, said wear shim assembly comprising:

a shim extending circumferentially about the interior of said engine case adjacent said shroud and said rail chamber, said case including a radial seating surface and an axial seating surface near said rail chamber, said shim further including, a first wear surface for protecting the radial seating surface of said engine case, said first wear surface being situated between said shroud and the radial seating surface, and a second wear surface for protecting the axial seating surface of said engine case, said second wear surface being situated between said shroud and said axial seating surface, wherein said shim is substantially U-shaped in cross section and includes first and second substantially parallel side surfaces and a connective member joining said first and second side surfaces, said connective member being said first wear surface, one of said first and second side surfaces being said second wear surface.

2. The wear shim assembly of claim 1 wherein said shim exhibits a split-ring geometry.

3. The wear shim assembly of claim 1 wherein said shim exhibits a substantially ring-like geometry which is divided into a plurality of subsections for ease of installation.

4. A wear shim assembly situated in the interior of a gas turbine engine having a longitudinal axis, said engine including an engine case and an array of stator vanes having mounting hooks attached to the interior of said engine case, the interior of said case including a circumferential rail chamber for receiving the hooks of said stator vanes, said engine including a shroud in the interior of said engine case, said wear shim assembly comprising:

a shim extending circumferentially about the interior of said engine case adjacent said rail chamber, said case including a radial seating surface and first and second axial seating surfaces near said rail chamber, said shim further including, a first wear surface for protecting the radial seating surface of said engine case, said first wear surface being situated between said hook and the radial seating surface;

a second wear surface for protecting the first axial seating surface of said engine case, said second wear surface being situated between said hook and said first axial seating surface, and a third wear surface for protecting said second axial seating surface of said engine case, said third wear surface being situated between said shroud and said second axial seating surface.

5. The wear shim assembly of claim 4 wherein said shim is substantially U-shaped in cross section and includes first and second substantially parallel side surfaces each having first and second opposed ends, and a connective member joining said first and second side surfaces at the first ends thereof, a circumferential radial surface member being connected to the second end of said first side surface, said circumferential radial surface member being said first wear surface, said first side surface being said second wear surface, and said second side surface being said third wear surface.

6. The wear shim assembly of claim 5 wherein said shim exhibits a split-ring geometry.

7. The wear shim assembly of claim 5 wherein said shim exhibits a substantially ring-like geometry which is divided into a plurality of subsections for ease of installation.

8. The wear shim assembly of claim 5 wherein said shim includes a plurality of spaced-apart cutouts around the circumference of said shim to decrease the meridional stiffness thereof.

* * * * *